US012544820B2

(12) United States Patent
Pfeifer

(10) Patent No.: US 12,544,820 B2
(45) Date of Patent: Feb. 10, 2026

(54) PUNCHING TOOL FOR MOBILE USE

(71) Applicant: Alfra GmbH, Hockenheim (DE)

(72) Inventor: Klaus Pfeifer, Hainburg (DE)

(73) Assignee: Alfra GmbH, Hockenheim (DE)

( * ) Notice: Subject to any disclaimer, the term of this patent is extended or adjusted under 35 U.S.C. 154(b) by 285 days.

(21) Appl. No.: 18/086,973

(22) Filed: Dec. 22, 2022

(65) Prior Publication Data

US 2023/0201905 A1 Jun. 29, 2023

(30) Foreign Application Priority Data

Dec. 23, 2021 (DE) ..... 10 2021 134 528.6

(51) Int. Cl.
*B21D 28/34* (2006.01)
*B21D 45/00* (2006.01)

(52) U.S. Cl.
CPC ..... *B21D 28/34* (2013.01); *B21D 45/003* (2013.01)

(58) Field of Classification Search
CPC .... B26D 7/1818; B21D 45/003; B21D 45/04; B21D 28/34; B21D 28/343; B21D 28/26; B21D 37/12; B21D 37/04; B25B 27/14; B26F 1/14
USPC ..... 83/686
See application file for complete search history.

(56) References Cited

U.S. PATENT DOCUMENTS 3,056,203 A * 10/1962 Calkins ..... B21D 28/002 30/360
3,641,860 A * 2/1972 Whistler, Sr. ..... B21D 28/34 83/699.41
4,403,417 A 9/1983 Wilson et al.
4,793,063 A * 12/1988 Ducret ..... B26F 1/34 30/360
5,327,631 A * 7/1994 Lincavage ..... B25D 5/00 279/46.2
2013/0145916 A1* 6/2013 Nordlin ..... B23D 35/004 29/428
2014/0208558 A1* 7/2014 Gass ..... B25B 27/14 29/283
2021/0039153 A1* 2/2021 Siemen ..... B21D 28/343
2021/0094086 A1* 4/2021 Laut ..... B21D 28/34

FOREIGN PATENT DOCUMENTS

WO 2011039696 A1 4/2011
WO WO-2020171918 A1 * 8/2020 ..... B26F 1/14

* cited by examiner

*Primary Examiner* — Nhat Chieu Q Do

(57) ABSTRACT

A punching tool that is capable of being used and modified independently of the shape of an opening to be punched, and is capable of being used for all round, angular and/or special-shaped tool contours. The punching tool generally comprises a cylinder with a fastener and a die having a lead-through for the fastener and a cavity with a stamp that is configured to connect to the fastener such that a spacer bushing is held to the cylinder.

3 Claims, 2 Drawing Sheets

PUNCHING TOOL FOR MOBILE USE

CROSS REFERENCE TO RELATED APPLICATIONS

The present application claims priority to DE 10 2021 134 528.6, filed on Dec. 23, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable.

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

Not Applicable.

STATEMENT REGARDING PRIOR DISCLOSURES BY THE INVENTOR OR A JOINT INVENTOR

Not Applicable.

BACKGROUND OF THE INVENTION

Field of the Invention

The invention relates to a punching tool for mobile use which has been improved in its handleability compared to conventional punching tools.

Description of Related Art Including Information Disclosed Under 37 CFR 1.97 and 1.98

It is known from prior art punches, such as those used in sheet metal processing, that during the processing operation the material to be processed, in particular sheet metal, is pressed by a mechanical force from a punch into a die corresponding thereto, which is arranged behind the material to be punched.

However, these known punches have a number of disadvantages, for example the large space requirement needed for stationary sheet metal working machines, which increases the greater the projection of the tools (maximum machinable edge distance). In contrast, the known mobile punches often have a rather small jaw depth and thus only allow material processing, in particular sheet metal processing, in the edge area of the material.

The remedy for this is to be found in generic hydraulic or pneumatic punching machines for mobile use. In mobile punches, the stamp is connected to the hydraulic cylinder by a screw or a bolt, whereby the material to be punched must already have a pre-drilled hole through which the screw or bolt is guided. The stamp is pulled directly into the die in this way. The necessity of the pre-drilled hole is often cited as a disadvantage here.

Such generic punching tools are known per se from the prior art. For example, EP 3 025 824 B1 describes a mobile hydraulic tool with a drive piston hydraulically adjustable between a starting position and an end position, a hydraulic tool housing comprising a cylinder section guiding the drive piston, and a drawing or pressure tool unit detachably connectable to the drive piston and the hydraulic tool housing.

For punching, it is necessary to bring an assembly consisting of cylinder, adapter with fastener, spacer and die up to the material to be punched and to guide it through an existing hole with the fastener before then connecting the stamp with the fastener on the opposite side of the material to be punched. It is precisely during the attachment and feed-through process that parts of the assembly, in particular the spacer and the die, can fall off in generic punching operations due to careless operation, which not only interrupts the process but can also cause damage to the material to be punched and to the individual components.

There is therefore a need for an inexpensive and effective solution to the aforementioned technical problems encountered in practice.

BRIEF SUMMARY OF THE INVENTION

The present invention is therefore based on the task of providing an improved punching tool for mobile use, in which no parts of an assembly can fall off even in the case of careless operation.

This task is solved in the present invention by a punching tool (1) for mobile use, comprising

- a cylinder (11)
- an adapter (13*a*) with fastening means (13*b*) attached thereto, the adapter (13*a*) being at least partially insertable into the cylinder (11) at its first end
- optionally a spacer bushing (15), which has a receiving opening (151) for the adapter (13*a*) and a lead-through (153) for the fastening means (13*b*),
- a die (17) having a lead-through (173) for the fastening means (13*b*) and a cavity (171), and
- a stamp (19) which can be connected to the fastening means (13*b*),
- characterised in that optionally the spacer bushing (15) or the die (17) is held to the cylinder (11) by first magnetic means (21).

According to the invention, the cylinder (11) is a hydraulic or pneumatic cylinder designed to draw the stamp (19) into the die (17) by means of an adapter (13*a*) and fastening means (13*b*) attached thereto.

According to the invention, the adapter (13*a*) serves to establish a connection between the fastening means (13*b*) and the cylinder (11).

The fastening means (13*b*) is anchored in the adapter (13*a*) on one side, and on its side remote from the cylinder (11) it has a device for force-locking connection of the stamp (19).

According to the invention, the spacer bushing (15) is used to compensate for height differences in order to optimise the positioning of the stamp (19) and, if necessary, to compensate for the difference of an offset fastening means (13*b*).

The spacer bushing (15) is optionally provided in a simple embodiment of the present invention. In this case, the die (17) is directly held to the cylinder (11) by the first magnetic means (21).

The "first magnetic means" (21) are in particular one or more magnets provided in at least one of two adjacent components. The arrangement of the first magnetic means (21) may be radial or axial.

If the components are made of a ferromagnetic material, magnets are sufficient in one of the two components, if the components are not made of a ferromagnetic material, at least ferromagnetic sections are provided in each case opposite the magnet(s) in the components.

First of all, the present invention has the advantage that the spacer bushing (15) is held to the cylinder (11) in a simple manner by the first magnetic means (21), the spacer bushing (15) in turn holding the assembly of adapter (13*a*) with fastening means (13*b*) attached thereto. Thus, none of these components can unintentionally fall from the punching tool according to the invention. Furthermore, it is possible to retrofit existing conventional punching tools, for example by subsequently providing the first magnetic means (21) or by partially replacing conventional components with components according to the invention.

The punching tool (1) according to the invention can be used and modified independently of the shape of the opening to be punched. In particular, it can be used for all round, angular and/or special-shaped tool contours.

In a preferred first embodiment, the die (17) is held to the spacer bushing (15) by second magnetic means (23). The second magnetic means (23) are embodied substantially identical as the first magnetic means (21).

This ensures that the die (17) cannot fall down unintentionally due to improper handling.

In a preferred second embodiment alternative to the first embodiment, the die (17) is held on the spacer bushing (15) by mechanical means. These mechanical means can, for example, be formed by screw connections or bayonet locks.

This also ensures that the die (17) cannot fall down unintentionally due to improper handling.

In this preferred second embodiment alternative to the first embodiment, the spacer bushing (15) preferably has an extended lead-through (153*b*), which on the one hand carries the mechanical means to hold the die (17). On the other hand, the extended lead-through (153*b*) also ensures a more uniform and stable guidance of the fastening means (13*b*).

A further development of the present invention provides that the first magnetic means (21) are arranged in the end face (111) or on the lateral surface of the cylinder (11). Both arrangements are equivalent according to the present invention, and the choice may depend on the size of the punching tool or on the materials used. This further development increases the variability of the present invention.

In order to reduce the applied magnetic force and to simplify the removal of the components from the assembly, clearances (157) may be provided in the end face (155) of the spacer bushing (15) facing the cylinder (11), i.e. in the component side opposite the magnetic field. For example, the components can then be easily removed from each other by simply rotating them against each other.

Another further embodiment of the present invention provides that the second magnetic means (23) are arranged in the end face (159) or on the lateral surface of the spacer bushing (15). Both arrangements are equivalent according to the invention, whereby the selection can be based on the size of the punching tool or on the materials used. This further development increases the variability of the present invention.

In order to reduce the applied magnetic force and to simplify the removal of the components from the assembly, clearances may be provided in the end face (175) of the die (17) facing the spacer bushing (15), i.e. in the component side opposite the magnetic field. For example, the components can then be easily removed from each other by simply turning them.

In a simple embodiment, the adapter (13*a*) and fastening means (13*b*) can be permanently fixed to each other.

A special further embodiment of the punching tool (1) according to the invention provides that adapter (13*a*) and fastening means (13*b*) are made in two parts and the fastening means (13*b*) has at least one projection (13*b*1) which, in the assembled state, is arranged inside the cavity (171) of the die (17).

For this particular further development, during assembly of the punching tool (1) according to the invention, the individual fastening means (13*b*) is first guided through the die (17) until the projection (13*b*1) rests within the cavity (171). Subsequently, the fastening means (13*b*) guided through the die (17) is guided through the optional spacer bushing (15) before it is connected to the adapter (13*a*). Finally, the adapter (13*a*) is anchored in the cylinder (11).

This particular further development has the advantage that a waste piece located in the cavity (171) after the punching process can be ejected in a simple manner by means of the projection (13*b*1).

In a particularly preferred embodiment, the fastening means (13*b*) is a screw.

According to the invention, the problem of punching waste described above is solved in another further embodiment in that, due to the first magnetic means (21) and/or the second magnetic means (23), a waste piece of the die punched out of the material to be punched can be ejected. In particular, if the magnetic force is sufficient, the waste piece can be pushed out of the die.

Further objectives, features, advantages and possible applications will be apparent from the following description of embodiments which do not restrict the invention, also with reference to the figures. In this context, all the features described and/or illustrated constitute the subject-matter of the invention, either individually or in any combination, even irrespective of their summary in the claims or their back references. The figures show:

DETAILED DESCRIPTION OF THE INVENTION

In the figures, all the same components are designated with the same reference signs, but for reasons of clarity not all reference signs are necessarily inserted in all illustrations.

The punching tool 1 according to the invention belongs to the mobile hydraulic/pneumatic tools which occur in the prior art in a variety of embodiments. A drive piston, which is hydraulically or pneumatically adjustable in a housing of the punching tool 1 between a starting position and an end position and slides in the cylinder 11, is used to actuate a tool unit connected to this drive piston. In the case of the embodiments shown here, the tool unit is the adapter 13*a* with fastening means 13*b* attached thereto, which in turn carry the die 17 and stamp 19 for the actual punching process.

Figure 1:
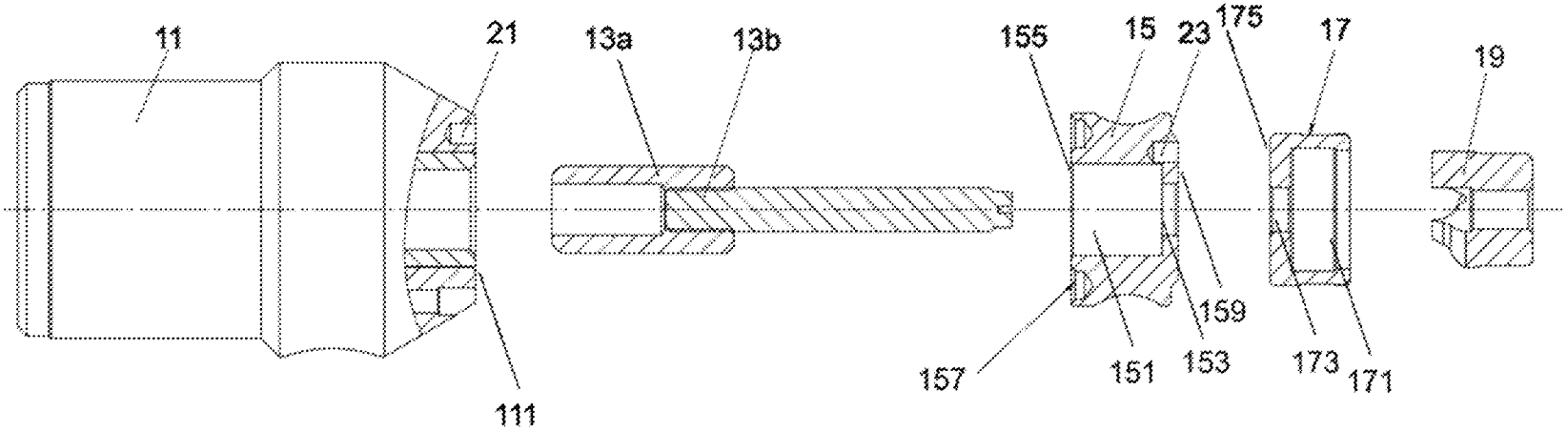
FIG. 1 a schematic exploded view of a punching tool 1 according to the invention in accordance with a first embodiment, and FIG. 2 a schematic exploded view of a punching tool 1 according to the invention in accordance with a second embodiment.

FIG. 1 shows the punching tool 1 according to a first embodiment in a schematic, partially cut-away exploded view. The adapter 13*a*, which is connected to the drive piston not shown here, is inserted into the cylinder 11. In the adapter 13*a*, the fastening means 13*b* is received in a force-fitting manner, for example screwed. In this embodiment, the adapter 13*a* and the fastening means 13*b* are designed as one component and are permanently connected to each other.

The fastening means 13*b* is pushed with its end facing away from the cylinder 11 through the lead-through 153 of the spacer bushing 15 until the adapter 13*a* rests in the receiving opening 151. According to the invention, the spacer bushing 15 is held on the cylinder by the first magnetic means 21. In the embodiment shown, permanent magnets (e.g. neodymium magnets) are embedded in the end face 111 of the cylinder 11 as first magnetic means 21.

These permanent magnets may be recessed flat with the end face 111 for maximum magnetic force. Alternatively, the permanent magnets may be located slightly lower than the face 111 so that the magnetic force on the spacer bushing 15 to be held is reduced. In this way, different magnetic forces can be realised depending on the size and weight of the spacer bushing 15 and the other components to be attached.

The die 17 is now pushed over the free end of the fastening means 13*b*, so that the fastening means 13*b* extends through its lead-through 173 and the cavity 171. In this embodiment, the die 17 is attached to the first magnetic means 21 via second magnetic means 23.

The punching die 1 according to the invention, which is largely assembled in this way, can now be brought up to the material to be punched and positioned as a force-locked assembly without any of the components falling off.

For the punching process, the still free outer end of the fastening means 13*b* is now guided through a pre-drilled hole in the material to be punched and the stamp 19 is attached to the fastening means 13*b* from the opposite side, for example by screwing it tight.

By actuating the punching tool, the stamp 19 is now pulled through the material to be punched into the cavity 171 and punches out the desired opening.

Figure 2:
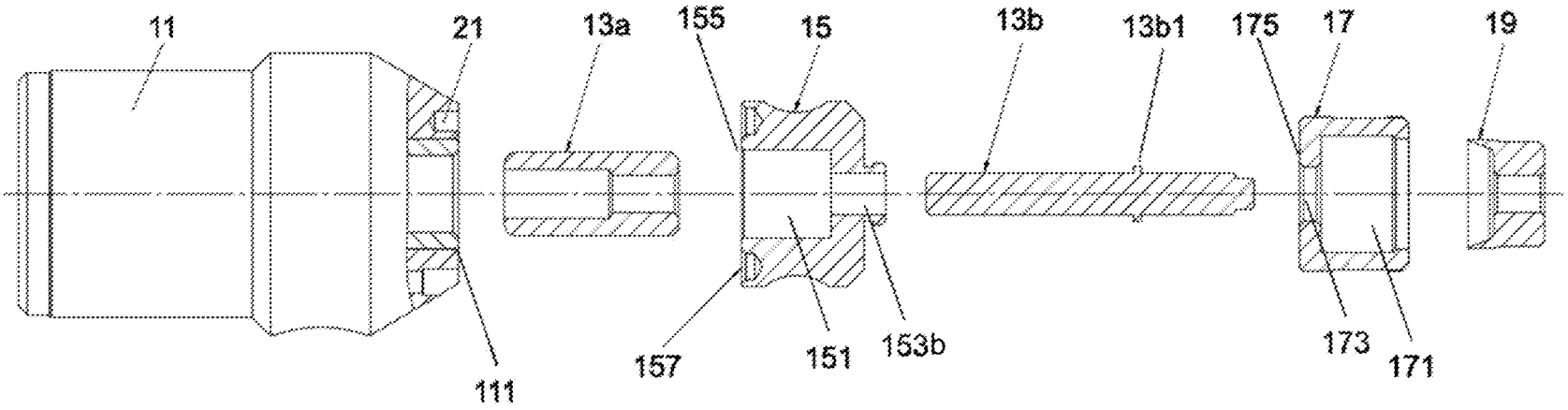

FIG. 2 shows the punching tool 1 according to the invention according to a second embodiment alternative to the first embodiment in a schematic, partially cut-away exploded view. FIG. 2 is largely identical to FIG. 1, so that the basic construction need not be described again.

The important difference here is that the adapter 13*a* and the fastening means 13*b* are made in two parts. In addition, the fastening means 13*b* has at least one projection 13*b*1, which is arranged inside the cavity 171 of the die 17 in the assembled state.

After the punching process, the punched waste piece of the punched material is located in the cavity 171 of the die 17, where it can get stuck depending on the type of material, its thickness and other factors. In order to remove the waste piece from the die of a conventional punching tool, additional tooling or auxiliary devices may have to be used, which can be quite time consuming.

However, by the particular embodiment of the present invention, the waste piece can very easily be reached by pushing the fastening means 13*b*, whereby the projection 13*b*1 engages behind the waste piece and pushes it out of the die 17.

Furthermore, in the illustration of FIG. 2, the die 17 is not held to the spacer bushing 15 by second magnetic means 23, but by mechanical means. These mechanical means may, for example, consist of a screw connection or a bayonet lock. The advantages of the preferably provided extended bushing 153*b* have already been discussed above.

However, such a connection by mechanical means is not mandatory for the embodiment shown. Thus, also in the second embodiment, the die 17 can be held to the spacer bushing 15 by second magnetic means 23.

REFERENCE SIGN

1 punching tool
11 cylinder
111 front surface of the cylinder
13*a* adapter
13*b* fastening means
13*b*1 projection
15 spacer bushing
151 receiving opening
153 lead-through for spacer bushing
155 end face of spacer bushing
157 clearances
159 end face of spacer bushing
17 die
171 cavity
173 lead-through of the die
175 end face of die
19 stamp
21 first magnetic means
23 second magnetic means

The invention claimed is:

1. A punching tool for mobile use, comprising:

a cylinder that has a first end and a second end, an adapter with a fastening means attached to said cylinder and configured to connect to a piston of the cylinder, the adapter being at least partially insertable into the cylinder at the first end, the first end of the cylinder having an end face and the cylinder having a lateral surface;

a die having a lead-through for the fastening means and a cavity, and a stamp which is configured to connect to the fastening means, a spacer bushing, the spacer bushing having a receiving opening for receiving the adapter and a lead-through for the fastening means;

wherein the spacer bushing is held to the cylinder by a first magnetic means;

wherein the first magnetic means are arranged in the end face or on the lateral surface of the cylinder, wherein the die is held on the spacer bushing by second magnetic means, wherein the second magnetic means are arranged in an end face or on a lateral surface of the spacer bushing.

2. The punching tool according claim 1, wherein the fastening means is a screw.

3. The punching tool according to claim 1, wherein clearances are provided in the end face of the die facing the spacer bushing.

* * * * *